United States Patent [19]

Kuwabara et al.

[11] Patent Number: 5,012,546

[45] Date of Patent: May 7, 1991

[54] LOOM CLEANING APPARATUS

[75] Inventors: Syokichi Kuwabara, Kawachinagano; Toyotoshi Yoshioka, Toyota, both of Japan

[73] Assignee: Luwa Japan Limited, Osaka, Japan

[21] Appl. No.: 549,428

[22] Filed: Jul. 6, 1990

[30] Foreign Application Priority Data

Jul. 12, 1989 [JP] Japan ..... 1-177886

[51] Int. Cl.[5] ..... D03J 1/00

[52] U.S. Cl. ..... 15/301; 15/352; 55/294; 139/1 C

[58] Field of Search ..... 15/301, 352; 139/1 C; 55/294

[56] References Cited

U.S. PATENT DOCUMENTS

| | | | |
|---|---|---|---|
| 1,048,[illegible]77 | 12/1912 | Allington | 15/301 X |
| 2,984,263 | 5/1961 | Loepsinger | 15/301 X |
| 3,142,856 | 8/1964 | Maguire | 15/301 X |
| 3,238,974 | 3/1966 | Maguire et al. | 139/1 C |
| 3,311,135 | 3/1967 | Maguire et al. | 139/1 C |
| 3,451,435 | 6/1969 | Riha et al. | 139/1 C |
| 3,921,675 | 11/1975 | Filter et al. | 139/1 C |
| 3,926,665 | 12/1975 | Harrap et al. | 55/294 X |
| 4,203,738 | 5/1980 | Kerman | 55/294 X |

*Primary Examiner*—Chris K. Moore

*Attorney, Agent, or Firm*—Burns, Doane, Swecker & Mathis

[57] ABSTRACT

A weaving loom cleaning apparatus comprising a duct extended across the loom and having upper and lower air-permeable walls at least one fan disposed within the duct to produce an air current flowing from the upper wall toward the lower wall of the duct, a fly collecting endless filtering belt disposed such that at least a part thereof runs along the upper surface of the duct, and a fly removing device disposed contiguously with the endless filtering belt, for removing flies collected on the endless filtering belt, and a central loom cleaning system for use in combination with a plurality of groups each composed of a plurality of looms each provided with the weaving loom cleaning apparatus. This weaving loom cleaning apparatus can be disposed in a compact space under the warp between the back beam of the weaving loom and the heddles of the same, and when the weaving loom cleaning apparatuses are used for a plurality of weaving looms, the equipment cost, power cost, and labor requirement for the disposal of the gathered flies can be reduced by the central loom cleaning system in accordance with the present invention.

11 Claims, 9 Drawing Sheets

LOOM CLEANING APPARATUS

BACKGROUND OF THE INVENTION

1. Field of the Inventions

The present invention relates to a weaving loom cleaning apparatus. In particular, the present invention relates to a weaving loom cleaning apparatus for collecting and removing flies while the weaving loom is in operation, to prevent an accumulation of flies under the weaving loom and a scattering of flies around the weaving loom.

Note, in the following description the weaving loom is referred to simply as a loom.

2. Description of the Related Art

Generally, flies produced by an operating loom are scattered by a draft around the loom. Namely, flies accumulated under the loom are often scattered by the draft around the loom, and the scattered flies are accumulated in lumps on warp yarns, to thereby become the cause of yarn breakages. This problem of scattered flies becomes more serious when a loom is operated at a higher weaving speed, such as a jet loom.

Various loom cleaning apparatus have been proposed to solve this problems; for example, Japanese Unexamined Utility Model Publication (Kokai) No. 62-122885 discloses a loom cleaning apparatus employing a porous pipe extended under the warp to draw flies therewithin by suction, and Japanese Unexamined Patent Publication (Kokai) No. 61-75849 discloses an loom cleaning apparatus which blows compressed air against the heddles and peripheral parts to blow flies off from the heddles and peripheral parts, and collects the scattered flies by suction.

These previously proposed loom cleaning apparatuses have various disadvantages, in that the loom cleaning apparatus disclosed in Japanese Unexamined Utility Model Publication (Kokai) No. 62-122885 is able to collect only flies that fall on the fly receiving surface and is unable to satisfactorily remove flies from the loom, and the loom cleaning apparatus disclosed in Japanese Unexamined Patent Publication (Kokai) No. 61-75849 is able to collect only some of the scattered flies. Accordingly, a loom cleaning apparatus capable of completely collecting and removing flies that are the cause of weaving problems has not been proposed to data.

SUMMARY OF THE INVENTION

Therefore, a primary object of the present invention is to provide a loom cleaning apparatus capable of completely collecting and removing flies produced by the operating loom, and ensuring that the flies do not adhere to the warp yarns.

Another object of the present invention is to provide a central loom cleaning system for use in combination with a plurality of looms provided respectively with the foregoing loom cleaning apparatus capable of efficiently removing flies.

The first object of the present invention is achieved by a loom cleaning apparatus disposed under the warp between the back beam of the loom and the heddles thereof, comprising: a duct extended across the loom and having upper and lower air-permeable walls; at least one fan disposed within the duct to produce an air current flowing from the upper wall toward the lower wall of the duct; a fly-collecting endless filtering belt disposed in such a manner that at least a part thereof runs along the upper surface of the duct; and a fly removing device disposed contiguously with the endless filtering belt, for removing flies collected on the endless filtering belt.

Preferably, the endless filtering belt is extended between guide rollers in such a manner that the upper side thereof runs horizontally along the upper surface of the duct and the lower side thereof runs horizontally along the lower surface of the duct. Alternatively, the endless filtering belt is guided by a deflecting means to run horizontally along the upper surface of the duct, to run substantially vertically along the side surface of the duct, and then to run toward the starting position. In the latter arrangement, the lower surface of the duct faces an open space, and thus a diffuser or a nozzle can be attached to the lower surface of the duct. The provision of the diffuser enables a reduction of the electric energy required for the operation of the fan, and the nozzle enables the use of air discharged by the fan for cleaning the lower portion of the loom.

The fans provided within the duct are axial fans arranged longitudinally of the duct, or tangential fans arranged longitudinally of the duct.

The fly removing device may be either a suction type or scraping type. The suction type fly removing device may be provided with a suction nozzle disposed near one end of the endless filtering belt, and the scraping type fly removing device may be a stationary scraping type fly removing device or may be a movable scraping type fly removing device associated with a fixed filter.

A central loom cleaning system may be used in combination with a plurality of groups each composed of a plurality of looms each provided with the loom cleaning apparatus. Such a central loom cleaning system comprises: a main duct; a fly gathering fan connected to the main duct; a fly stock bin connected through the fly gathering fan to the main duct; branch ducts branched from the main duct and extended along the looms of the groups, respectively, and each connected to the fly removing device of the loom cleaning apparatus incorporated into the looms of the corresponding group; on-off valves connecting the branch ducts, respectively, to the main duct; and a control unit for sequentially opening and closing the on-off valves.

DESCRIPTION OF THE PREFERRED EMBODIMENTS

The loom cleaning apparatuses as preferred embodiments according to the present invention, and a central loom cleaning system in a preferred embodiment according to the present invention, will be described hereinafter with reference to the accompanying drawings.

Figure 1:
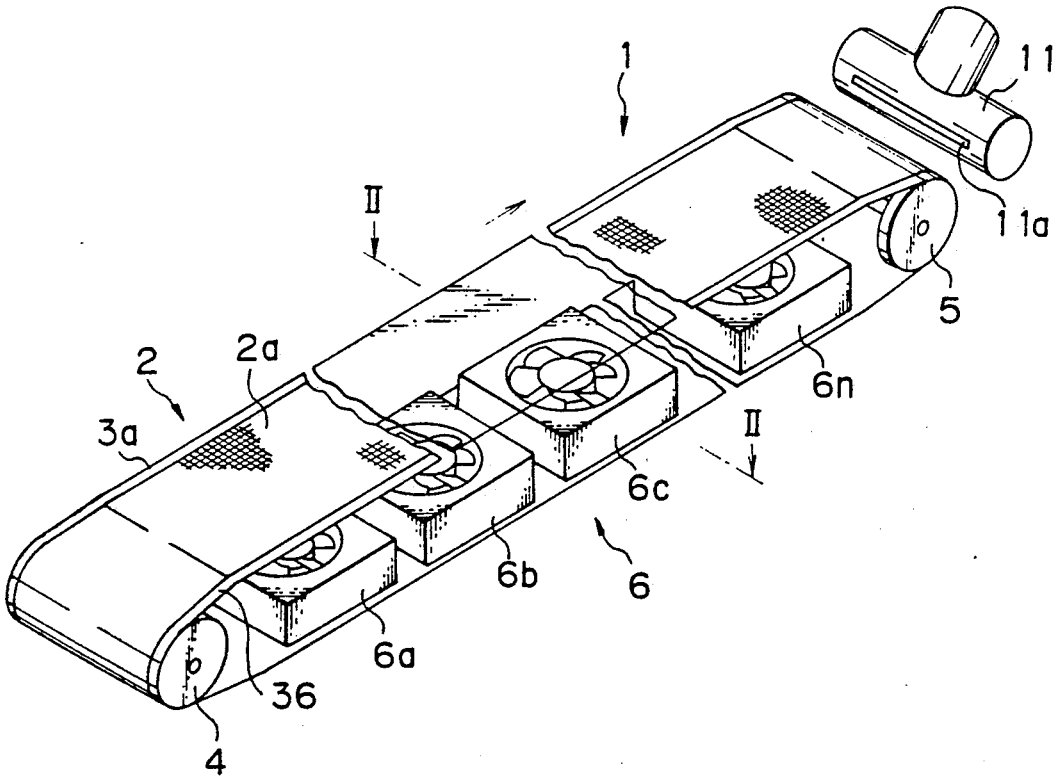
FIG. 1 is a perspective view of a loom cleaning apparatus in accordance with the present invention, from which the duct is omitted.
Figure 2:
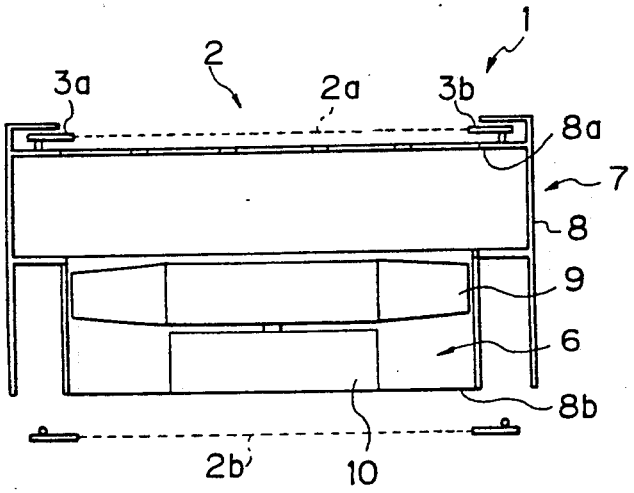
FIG. 2 is a sectional view taken along the line II—II in FIG. 1.

FIG. 1 is a perspective view of an essential portion of a loom cleaning apparatus in a first embodiment according to the present invention, and FIG. 2 is a cross-sectional view taken along the line II—II in FIG. 1. As shown in FIGS. 1 and 2, the loom cleaning apparatus 1 comprises a duct 7, which is omitted in FIG. 1 to facilitate the reading of the drawing, an endless filtering belt 2 for collecting flies, a plurality of axial fans 6, i.e., axial fans 6*a* to 6*n*, arranged within the duct 7 to attract flies to the endless filtering belt 2, and a fly removing device 11 for removing flies collected on the endless filtering belt 2.

As shown in FIG. 2, the duct 7 defines an elongated chamber 8 having the shape of a rectangular cylinder and extending across the loom. The upper surface 8*a* of the chamber 8 is bounded by a perforated plate having a high open area ratio, and the lower surface 8*b* of the chamber is provided with a large opening, and thus air is able to flow downward through the duct 7. Each axial fan 6 has an impeller 9, and a motor 10 for rotating the impeller 9. The axial fans 6*a* to 6*n* are arranged longitudinally at intervals in the chamber 8, to produce uniformly distributed air currents that flow across the chamber 8 to provide a suction force.

The endless filtering belt 2 is disposed in such a manner that the upper side thereof runs substantially in a horizontal plane along the upper wall of the duct 7, and the lower side thereof runs substantially in a horizontal plane along the lower wall of the duct 7. The endless filtering belt 2 is extended between driving pulleys 4 with a built-in motor and tension pulleys 5. The endless filtering belt 2, in general, is an endless wire mesh belt, but the endless filtering belt 2 may be formed of any other suitable material provided that the endless filtering belt 2 is capable of collecting flies. Indicated at 3*a* and 3*b* in FIG. 1 are reinforcing bands for reinforcing the endless filtering belt 2, to lengthen the service life of the endless filtering belt 2.

The fly removing device 11 is disposed near one end of the endless filtering belt 2 on the side of the tension pulleys 5, to remove flies collected on the outer side 2*a* of the endless filtering belt 2 with a suction nozzle 11*a* by suction as the endless filtering belt 2 turns in the direction indicated by an arrow.

Figure 3:
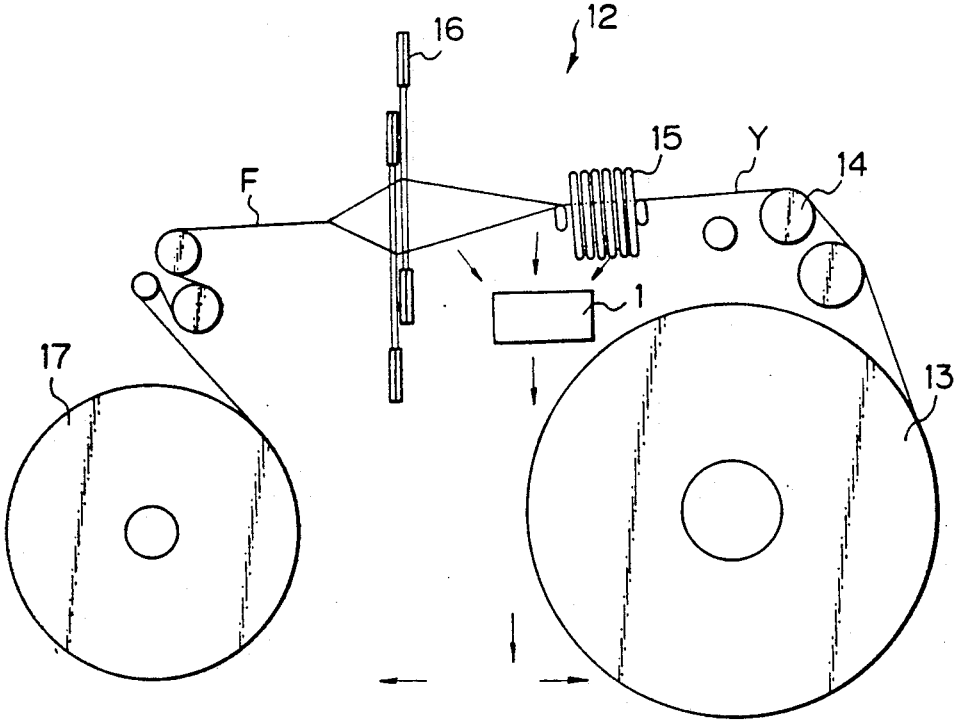
FIG. 3 is a schematic front view of an air jet loom incorporating the loom cleaning apparatus in accordance with the present invention.
Figure 4:
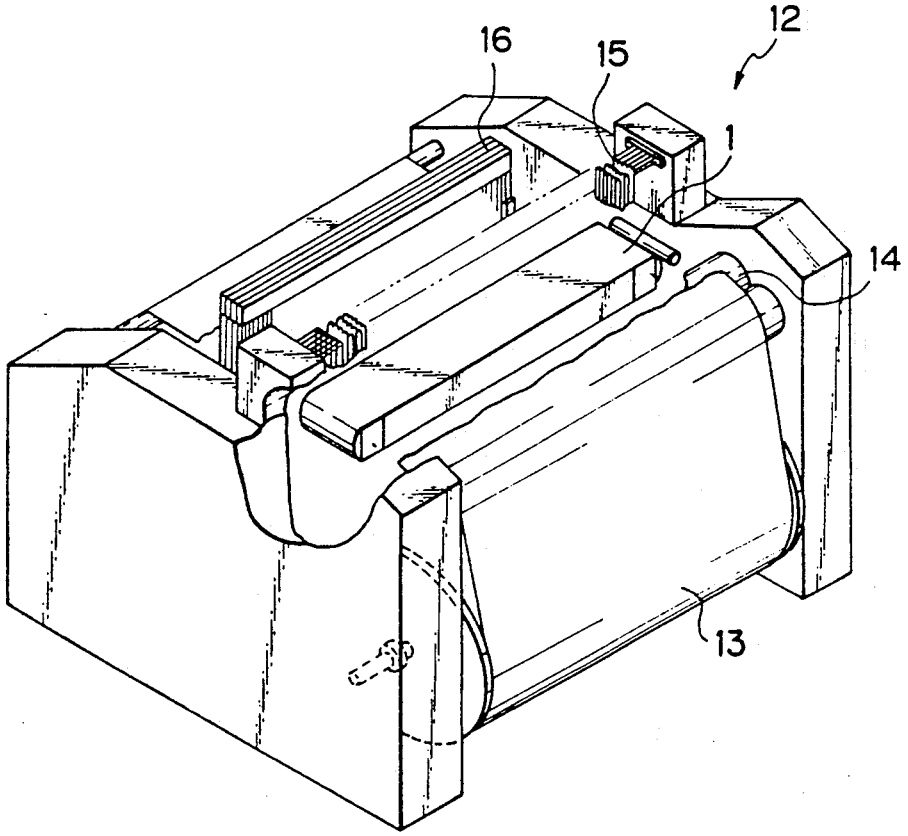
FIG. 4 is a perspective view corresponding to FIG. 3.

FIGS. 3 and 4 show the loom cleaning apparatus 1 incorporated into an air jet loom 12. As is generally known, a number of warp yarns Y let off from a warp beam 13 are advanced via a back beam 14, drop wires 15, and heddles 16. A weft yarn inserted in a shed formed by the heddles 16 is beaten with a reed, not shown, to weave a woven fabric F which, in turn, is rolled in a cloth roll 17 on a cloth roller. As the warp yarns Y pass the drop wires 15 and the heddles 16, the warp yarns Y are abraded by the drop wires 15 and the heddles 16 and rub against each other, to produce flies which fall down and are deposited on the floor under the loom. These flies deposited on the floor can be scattered by a draft and adhere to the warp yarns Y.

As shown in FIG. 3, a space between the back beam 14 and the heddles 16 under the warp yarn Y is available for installing the loom cleaning apparatus 1. As mentioned previously, the loom cleaning apparatus 1 produces downward air currents, and thus the loom cleaning apparatus 1 allows the air to flow downward, together with flies, therethrough as indicated by arrows in FIG. 3. Accordingly, the flies produced by the drop wires 15 and the heddles 16 are trapped by the endless filtering belt 2 of the loom cleaning apparatus 1, and the trapped flies are removed from the endless filtering belt 2, and thus a deposit of flies on the floor under the loom cleaning apparatus 1 does not occur.

Figure 5:
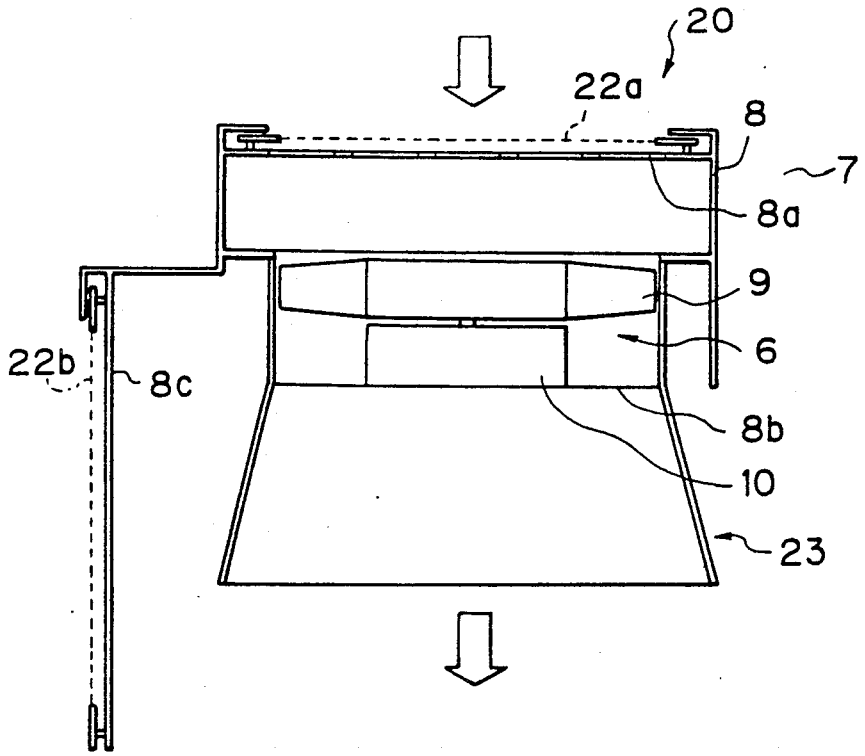
FIG. 5 is a sectional view, similar to FIG. 2, of a loom cleaning apparatus in a second embodiment in accordance with the present invention.
Figure 6:
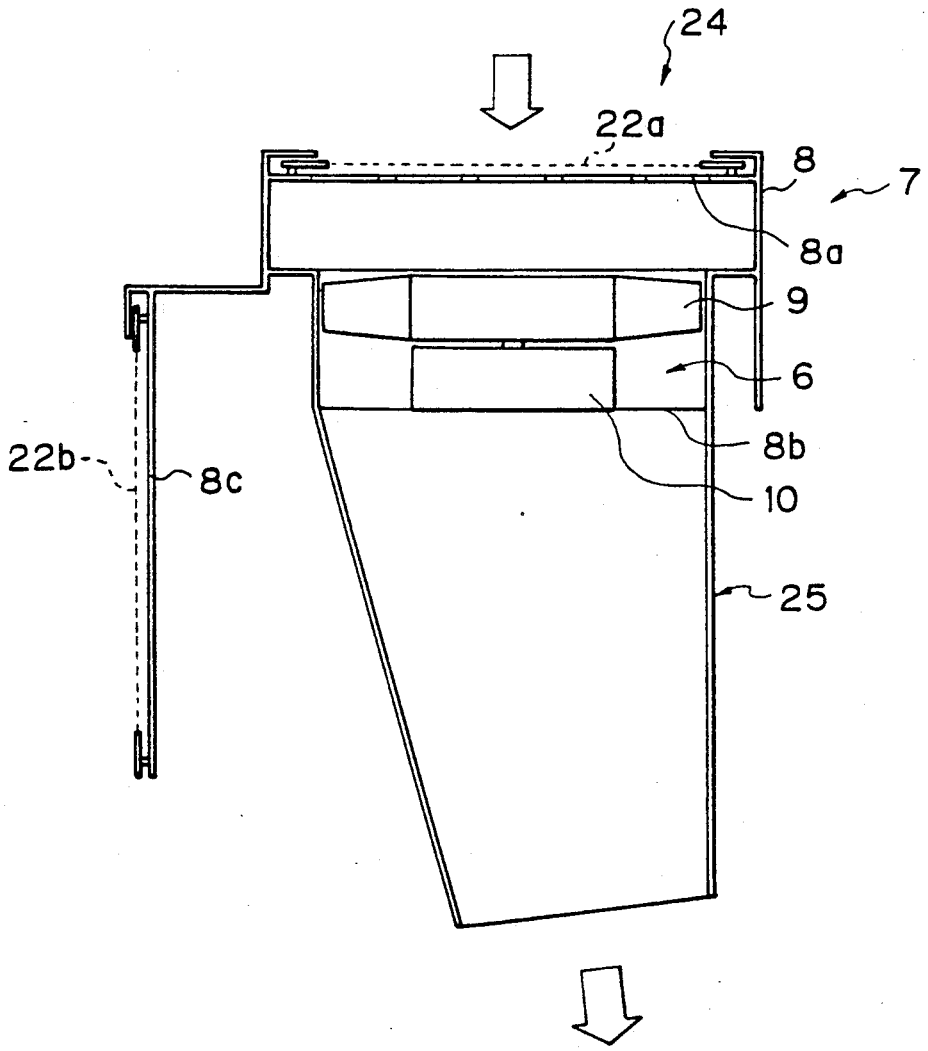
FIG. 6 is a sectional view, similar to FIG. 2, of a loom cleaning apparatus in a third embodiment in accordance with the present invention.
Figure 8:
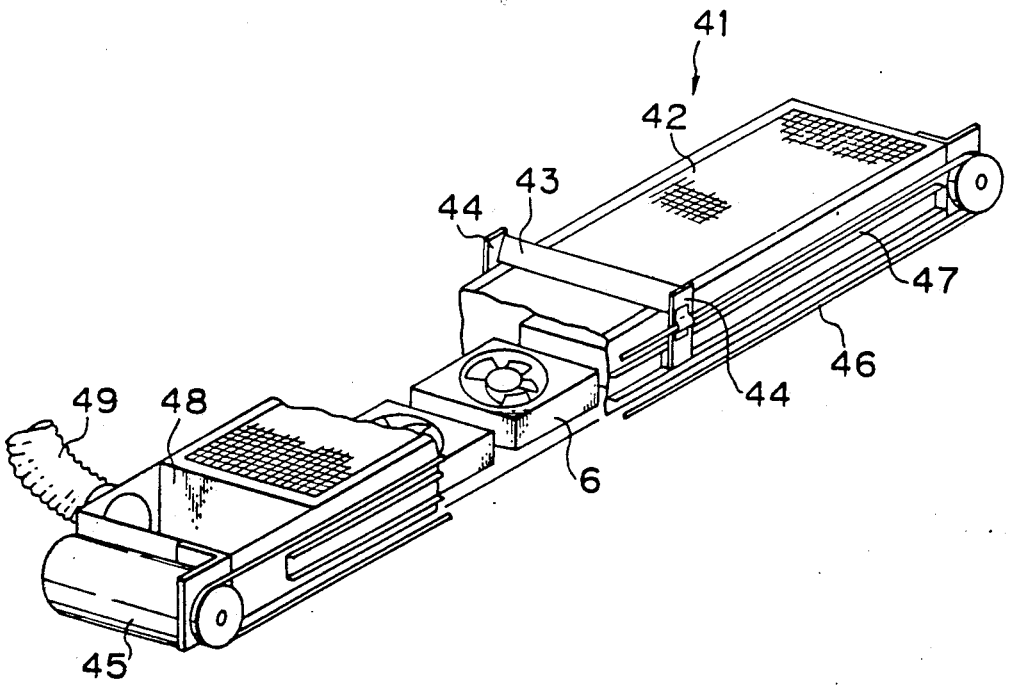

FIGS. 5 and 6 show the loom cleaning apparatus 1 in second and third embodiments thereof according to the present invention, respectively. In these second and third embodiments, the upper side 22*a* of the endless filtering belt moves along the upper surface 8*a* of the chamber 8 of the duct 7, and is guided by a deflecting device disposed on one end of the loom cleaning device 1 to move substantially in a vertical direction along the side surface 8*c* of the chamber 8, as indicated at 22*b*. Then, the portion 22*b* is guided by a deflecting device, not shown, disposed at the other end of the loom cleaning apparatus 1 to again move horizontally, and thus an open space is formed under the lower surface 8*b* of the chamber 8. As shown in FIG. 5, a diffuser 23 may be provided in the open space under the lower surface 8*b*, to reduce the amount of electric energy required for the operation of the axial fans 6, and as shown in FIG. 8, a nozzle 25 may be provided in the open space under the lower surface 8*b* to use air discharged from the loom cleaning apparatus 1 for cleaning the bottom portion of the loom.

A high-speed, high-performance loom has a compact construction, and thus only a very small space, compared with that in the conventional loom, is available between the warp beam and the heddles. Nevertheless, the compact construction, for example, 150 mm wide and 90 mm high in cross section, of the loom cleaning apparatus in accordance with the present invention makes it applicable to all kinds of looms.

In a weaving mill, in general, a number of looms are installed in groups, and when all the looms are each equipped with the loom cleaning apparatus 1 of the present invention, collecting the flies accumulated in the fly removing devices 11 of the loom cleaning apparatus 1 from individual fly removing devices 11 is very difficult and thus impractical.

Figure 7:
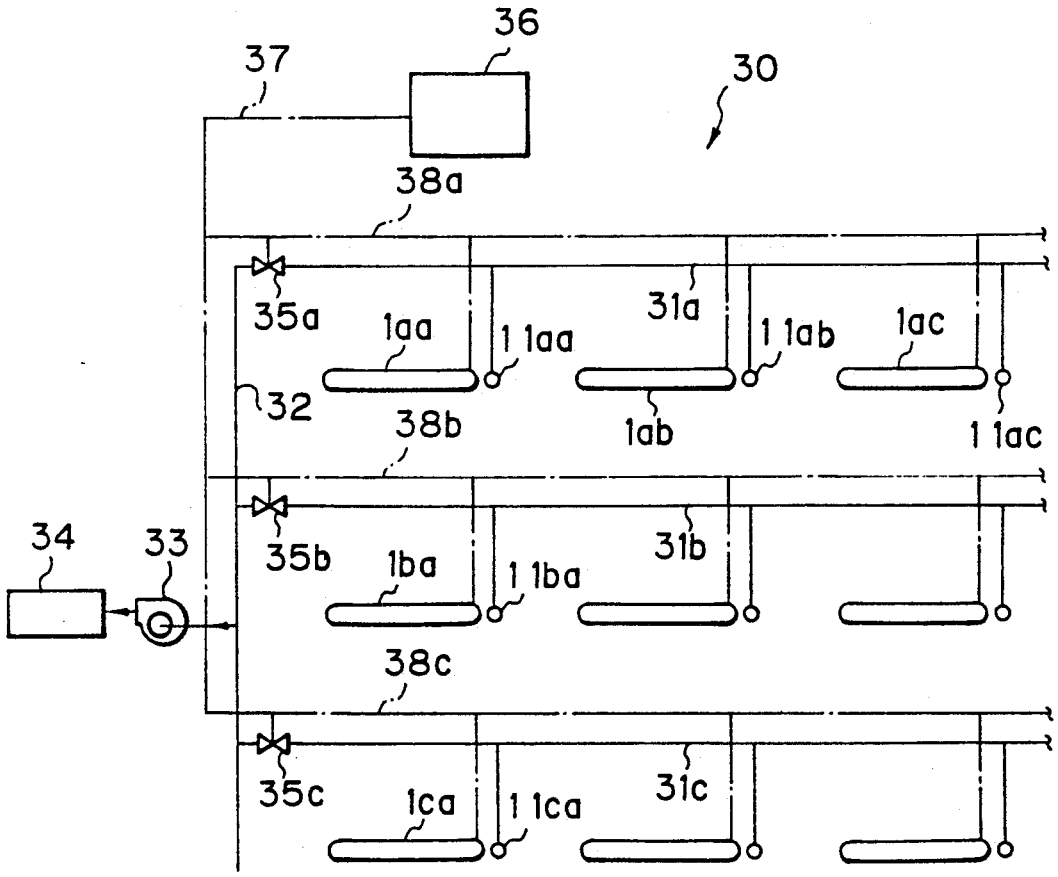
FIG. 7 is a central loom cleaning system embodying the present invention for cleaning a plurality of looms; and, FIGS. 8 to 10 are perspective views of loom cleaning apparatuses as fourth, fifth and sixth embodiments, respectively, in accordance with the present invention.

FIG. 7 shows an arrangement for facilitating the collection of the flies accumulated in the fly removing devices 11 of the loom cleaning apparatus 1 incorporated into a number of looms, in which the looms are represented by the loom cleaning apparatus 1.

The looms are divided into a group of looms 1*aa*, 1*ab*, 1*ac*, . . . a group of looms 1*ba*, 1*bb*, 1*bc*, . . . and a group of looms 1*ca*, 1*cb*, 1*cc*, . . . ; a group of fly removing devices 11*aa*, 11*ab*, 11*ac*, . . . , a group of fly removing devices 11*ba*, 11*bb*, 11*bc*, . . . , and a group of fly removing devices 11*ca*, 11*cb*, 11*cc*, . . . are connected respectively to branch ducts 31*a*, 31*b*, 31*c*, . . . ; the branch ducts 31*a*, 31*b*, 31*c*, . . . are connected respectively through on-off valves 35*a*, 35*b*, 35*c*, . . . to a main duct 32; and the main duct 32 is connected through a fly gathering fan 33 to a fly stock bin 34. A controller 36 may be provided to open and close the on-off valves 35*a*, 35*b*, 35*c*, . . . sequentially one at a time, and to operate the loom cleaning apparatus when the on-off valve is open. In FIG. 7, 37, 38*a*, 38*b* and 38*c* are signal lines connecting the on-off valves or the loom cleaning apparatus to the controller 36.

Although the loom cleaning apparatus is operated continuously, the operation for collecting the flies deposited on the endless filtering belts 2 of the loom cleaning apparatus of each group is performed intermittently.

The arrangement shown in FIG. 7 enables the use of a single fly gathering fan and a single fly stock bin for gathering the flies from the fly removing devices at all of the looms. Note, since the fly gathering operation is performed for each group of looms, the fly gathering fan may have a comparatively small capacity.

Figure 9:
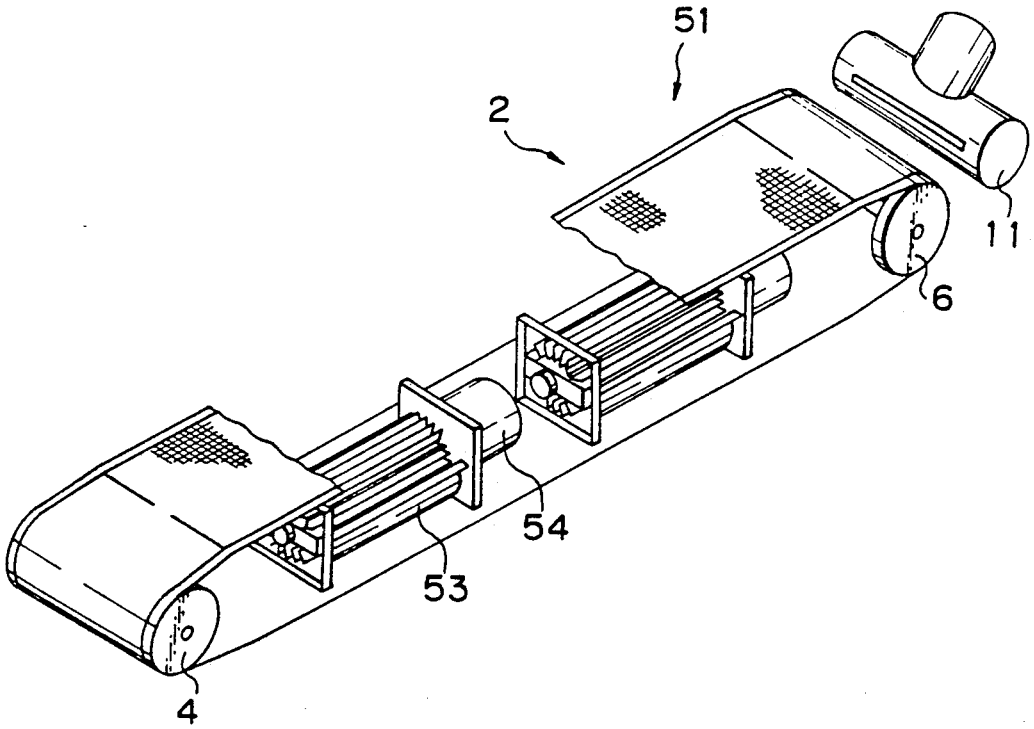
Figure 10:
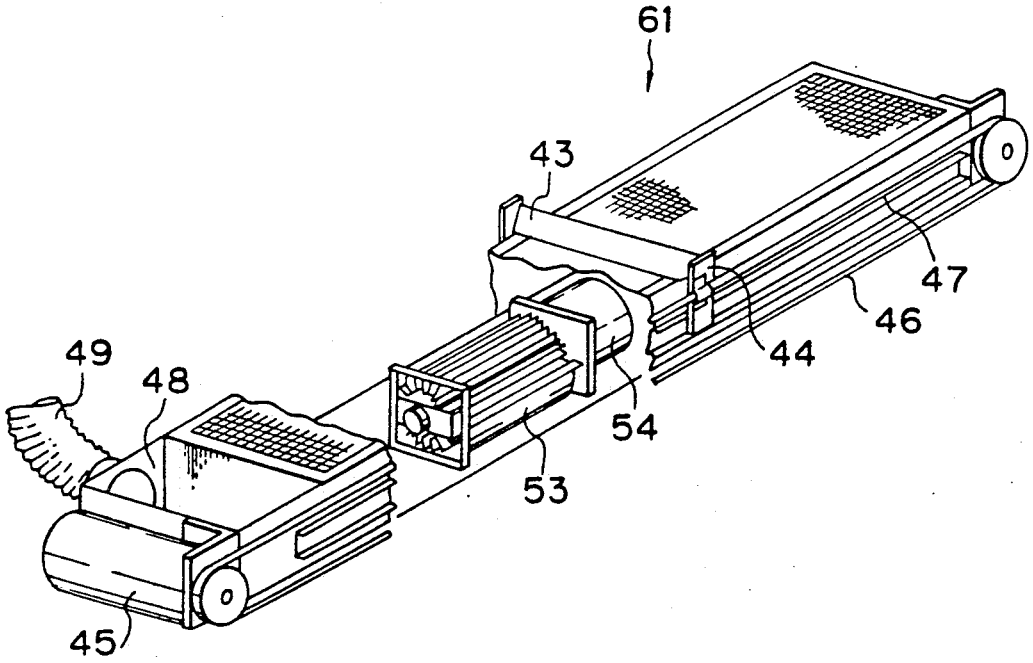

FIGS. 8, 9, and 10 show loom cleaning apparatuses as fourth, fifth, and sixth embodiments according to the present invention.

The loom cleaning apparatus 41 shown in FIG. 8 employs a fixed filter 42, and a scraping type moving fly removing device provided with a scraper 43. The fly removing device travels along the upper surface of the filter 42, and the scraper 43 is supported at opposite end thereof by brackets 44 and each bracket 44 is reciprocated along a guide rail 47 by a belt driven by a scraper driving motor 45. As the scraper 43 is moved from the upper right-hand side toward the lower left-hand side, as viewed in FIG. 8, the scraper 43 scrapes off and gathers the flies deposited over the filter 42, and finally, discards the gathered flies into a fly collecting case 48. The flies collected in the fly collecting case 48 are removed from the fly collecting case 48 through a fly gathering pipe 49. The fly removing device shown in FIG. 1 disposed at one end of the endless filtering belt may be replaced by a scraping type fly removing device.

The loom cleaning apparatus 51 shown in FIG. 9 employs tangential fans 53 each provided with a motor 54, instead of the axial fans shown in FIG. 1. The tangential fans 53 are arranged in a space between the upper and lower sides of the endless filtering belt 2 as shown in FIG. 9, and uniformly blow out air in a tangential direction. Such a tangential fan is described in detail in, for example, Japanese Patent Publication (Kokoku) No. 01-25630.

The loom cleaning device 61 shown in FIG. 10 employs the tangential fans 53 and a scraping type fly removing device.

As apparent from the foregoing description, a loom cleaning apparatus constructed in accordance with the present invention collects, gathers, and removes flies produced at the loom, to prevent an adherence of the flies to the warp yarns. Since only the filter and the fans for producing air currents through the filter are provided as the principal components, the loom cleaning apparatus of the present invention can be installed in a comparatively narrow space under the upper components of the loom.

The employment of a central loom cleaning system of the present invention enables flies to be gathered from a plurality of looms by using a single fly gathering fan having a comparatively small capacity, and a single fly stock bin connected to the fly gathering fan, which reduces equipment and power costs and reduces the labor needed for the disposal of the gathered flies.

We claim:

1. A loom cleaning apparatus disposed under a warp between a back beam of a loom and heddles thereof, comprising: a duct extended across the loom and having upper and lower air-permeable walls; at least one fan disposed within the duct to produce an air current flowing from an upper wall toward a lower wall of the duct; a fly collecting endless filtering belt disposed such that at least part thereof runs along an upper surface of the duct; and a fly removing device disposed contiguously with the endless filtering belt, for removing flies collected on the endless filtering belt.

2. A loom cleaning apparatus according to claim 1, wherein the endless filtering belt is extended between guide rollers in such a manner that an upper side thereof runs horizontally along an upper surface of the duct, and a lower side thereof runs horizontally along a lower surface of the duct.

3. A loom cleaning apparatus according to claim 1, wherein the endless filtering belt is guided by deflecting means to run horizontally along the upper surface of the duct, to run substantially vertically along the side surface of the duct, and then to run toward a starting position thereof, and a means for controlling air exhausting provided on the lower surface of the duct to control a discharge of the air.

4. A loom cleaning apparatus according to claim 3, wherein a diffuser is used as the air exhausting control means.

5. A loom cleaning apparatus according to claim 3, wherein a nozzle is used as the air exhausting control means.

6. A loom cleaning apparatus according to claim 1, wherein at least one axial fan is disposed within the duct in such a manner that an axis thereof is extended longitudinally of the duct.

7. A loom cleaning apparatus according to claim 1, wherein the fly removing device is a suction type device provided with suction nozzles disposed at a position near to the endless filtering belt.

8. A loom cleaning apparatus according to claim 1, wherein the fly removing device is a scraping type device disposed at a position near to the endless filtering belt.

9. A loom cleaning apparatus disposed under the warp between the back beam of the loom and the heddles of the loom to collect and remove flies produced during the weaving operation of the loom, comprising: a duct extended across the loom and having air-permeable upper and lower walls; at least one fan disposed within the duct to produce an air current flowing from the upper surface toward the lower surface of the duct; a filtering member fixedly extended along the upper surface of the duct; and a scraping type fly removing device which is traveled along the filtering member to remove and collect flies collected on the filtering member.

10. A central loom cleaning system for use in combination with a plurality of groups each composed of a plurality of looms each provided with the loom cleaning apparatus according to claim 1, comprising: a main duct; a fly gathering fan connected to the main duct; a fly stock bin connected through the fly gathering fan to the main duct; branch ducts branched from the main duct and extended along the loom of the groups, respectively, and each connected to the fly removing device of the loom cleaning apparatus incorporated into the looms of the corresponding group; on-off valves connecting the branch ducts, respectively, to the main duct; and a control unit for sequentially opening and closing the on-off valves.

11. A central loom cleaning system for use in combination with a plurality of groups each composed of a plurality of looms each provided with the loom cleaning apparatus according to claim 9, comprising: a main duct; and fly gathering fan connected to the main duct; a fly stock bin connected through the fly gathering fan to the main duct; branch ducts branched from the main duct and extending along the loom of the groups, respectively, and each connected to the fly removing device of the loom cleaning apparatus incorporated into the looms of the corresponding group; on-off valves connecting the branch ducts, respectively, to the main duct; and a control unit for sequentially opening and closing the on-off valve.

* * * * *